US009428325B2

(12) United States Patent
Morgan et al.

(10) Patent No.: US 9,428,325 B2
(45) Date of Patent: Aug. 30, 2016

(54) PACKAGE ASSEMBLY FOR MONETARY PAYMENT CARDS AND RELATED METHOD

(71) Applicants: William E. Morgan, Guilford, IN (US); Dean A. Pomerville, Harrison, OH (US); Kelly S. Weiler, Batesville, IN (US)

(72) Inventors: William E. Morgan, Guilford, IN (US); Dean A. Pomerville, Harrison, OH (US); Kelly S. Weiler, Batesville, IN (US)

(73) Assignee: DEUFOL SUNMAN INC., Sunman, IN (US)

( * ) Notice: Subject to any disclaimer, the term of this patent is extended or adjusted under 35 U.S.C. 154(b) by 123 days.

(21) Appl. No.: 14/221,395

(22) Filed: Mar. 21, 2014

(65) Prior Publication Data

US 2014/0291189 A1 Oct. 2, 2014

Related U.S. Application Data

(60) Provisional application No. 61/807,594, filed on Apr. 2, 2013, provisional application No. 61/812,501, filed on Apr. 16, 2013, provisional application No. 61/821,998, filed on May 10, 2013.

(51) Int. Cl.

| | |
|---|---|
| ***B65D 73/00*** | (2006.01) |
| ***B65D 85/00*** | (2006.01) |
| ***B65D 5/42*** | (2006.01) |

(52) U.S. Cl.

CPC ..... *B65D 85/70* (2013.01); *B65D 5/4208* (2013.01); *B65D 73/0014* (2013.01); *B65D 73/0092* (2013.01); *B65D 2101/00* (2013.01)

(58) Field of Classification Search

CPC ..... B65D 85/70; B65D 73/0092; B65D 2101/00

USPC ..... 206/461, 463

See application file for complete search history.

(56) References Cited

U.S. PATENT DOCUMENTS

| | | | | |
|---|---|---|---|---|
| 3,233,725 | A * | 2/1966 | Bixler | B65D 75/305 206/461 |
| 3,942,640 | A * | 3/1976 | Hellstrom | B65D 75/366 206/461 |
| 4,739,883 | A * | 4/1988 | Mohs | B65D 73/00 206/461 |
| 4,953,700 | A * | 9/1990 | DeDino | B65D 73/0092 206/461 |
| 6,308,832 | B1 * | 10/2001 | Pirro | B65D 73/0092 206/462 |
| 6,619,480 | B2 * | 9/2003 | Smith | B65D 73/0078 206/454 |
| 6,957,737 | B1 * | 10/2005 | Frederickson | G06Q 20/3437 206/449 |
| 7,000,844 | B1 * | 2/2006 | Smith | G06K 19/07726 235/487 |
| 7,267,284 | B1 | 9/2007 | Smith | |
| 7,429,036 | B2 | 9/2008 | McGrane | |
| D632,735 | S | 2/2011 | McGrane et al. | |
| 7,992,774 | B2 | 8/2011 | Lynch et al. | |
| 8,397,376 | B2 | 3/2013 | Meeker et al. | |

(Continued)

*Primary Examiner* — Nathan J Newhouse
*Assistant Examiner* — Jennifer N Zettl
(74) *Attorney, Agent, or Firm* — Thompson Hine LLP

(57) ABSTRACT

A payment card package assembly includes a payment card, a panel, and a security label. The payment card has a card number thereon. The panel has a front side, and has warning indicia on the front side at a location outward of the perimeter of the payment card. The security label has a first portion that covers at least a portion of the card number, and has a second portion that covers the warning indicia in a front view of the assembly.

19 Claims, 13 Drawing Sheets

(56) References Cited

U.S. PATENT DOCUMENTS 8,403,229 B2 * 3/2013 McGrane ..... G06Q 20/20 235/380
8,419,889 B2 * 4/2013 Smith ..... B65D 75/26 156/277
2004/0011698 A1 * 1/2004 Gaffney ..... B65D 83/0454 206/704
2006/0278551 A1 * 12/2006 Bianchini ..... B65D 75/22 206/463
2007/0051652 A1 * 3/2007 Tilton ..... B65D 73/0092 206/462
2012/0187026 A1 * 7/2012 Nazari ..... B65D 73/0092 206/778
2012/0256003 A1 * 10/2012 Boge ..... G06K 19/083 235/488

* cited by examiner

PACKAGE ASSEMBLY FOR MONETARY PAYMENT CARDS AND RELATED METHOD

RELATED APPLICATIONS

This application claims the benefit of U.S. Provisional Application 61/807,594, filed Apr. 2, 2013, U.S. Provisional Application 61/812,501, filed Apr. 16, 2013, and U.S. Provisional Application 61/821,998, filed May 10, 2013, all of which are incorporated by reference in their entireties.

TECHNICAL FIELD

This application relates generally to package assemblies for monetary payment cards such as gift cards, debit cards, credit cards, prepaid cards and the like.

BACKGROUND

The market for the sale by retail establishments of payment cards of all types continues to increase. As more enhanced card features become available, the laws and regulations applicable to such retail sales likewise increase, and package security therefore becomes ever more important. It is necessary to provide the retail customer with a variety of information regarding the payment card, while at the same time providing a package that is reasonable in size. Moreover, as the retail sale of reloadable type cards becomes more prevalent, providing enhanced security against the sale of a packaged card that has been compromised by the criminal element is key.

One tactic the criminal element has used in the past to compromise payment cards has been to remove the card from the package in order to obtain the card number. The card is then reinserted into the package for subsequent sale to a retail customer. The criminal element then monitors the card to identify when it is subsequently sold and activated, at which point the criminal element accesses the funds on the card.

It would be desirable to provide a payment card package assembly that facilitates providing the customer with all information regarding the payment of the card as required by applicable law and regulation. It would also be desirable to provide a payment card package assembly that is better adapted to alerting both the customer and the retailer when a card has been compromised by removal from the package and subsequent reinsertion prior to sale.

SUMMARY

In one aspect, a payment card package assembly comprises a payment card, a panel, and a security label. The payment card has a card number thereon. The panel has a front side, and has warning indicia on the front side at a location outward of the perimeter of the payment card. The security label has a first portion that covers at least a portion of the card number, and has a second portion that covers the warning indicia in a front view of the assembly.

In another aspect, a payment card package assembly comprises a payment card, a security label, and a blister pack. The payment card has a card number thereon. The security label has a first portion covering at least a portion of the card number, and has a second portion extending beyond the perimeter of the payment card. The blister pack defines a pocket having a primary portion that contains the payment card and the first portion of the security label, and has a smaller secondary portion that projects from the primary portion and contains the second portion of the security label.

In a further aspect, a payment card package assembly comprises multiple payment cards, a panel, and a security label. The payment cards are arranged in an overlapping staggered orientation having a perimeter, and include a front payment card and a rear payment card with an edge portion protruding from behind the front payment card. The panel has a front side, and has warning indicia on the front side at a location outward of the perimeter of the overlapping staggered orientation. The security label covers at least a portion of a card number on the front payment card, and reaches from the front payment card onto the edge portion of the rear payment card. The security label also extends from the perimeter of the overlapping staggered orientation over the warning indicia on the panel to block the warning indicia from view.

DETAILED DESCRIPTION

Figure 2:
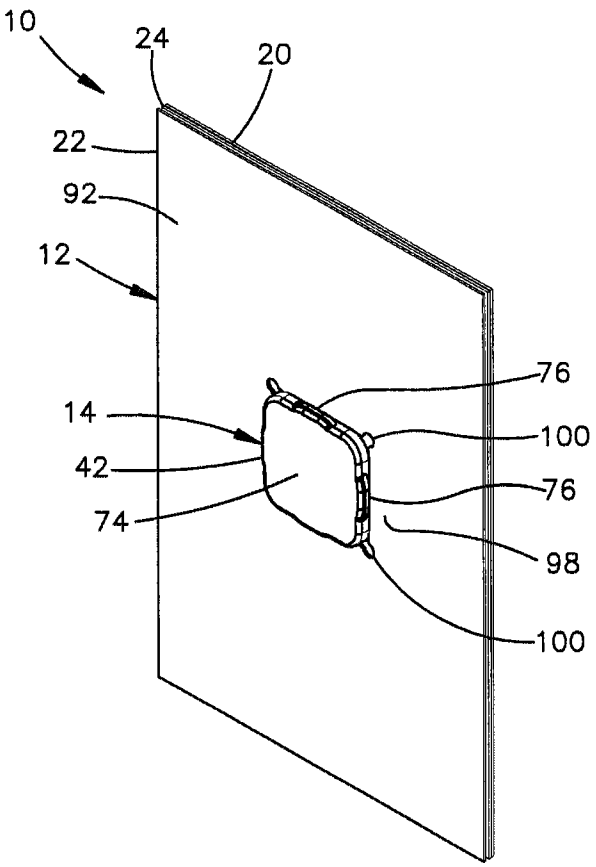
FIG. 2 is a rear perspective view of the assembly of FIG. 1.
Figure 1:
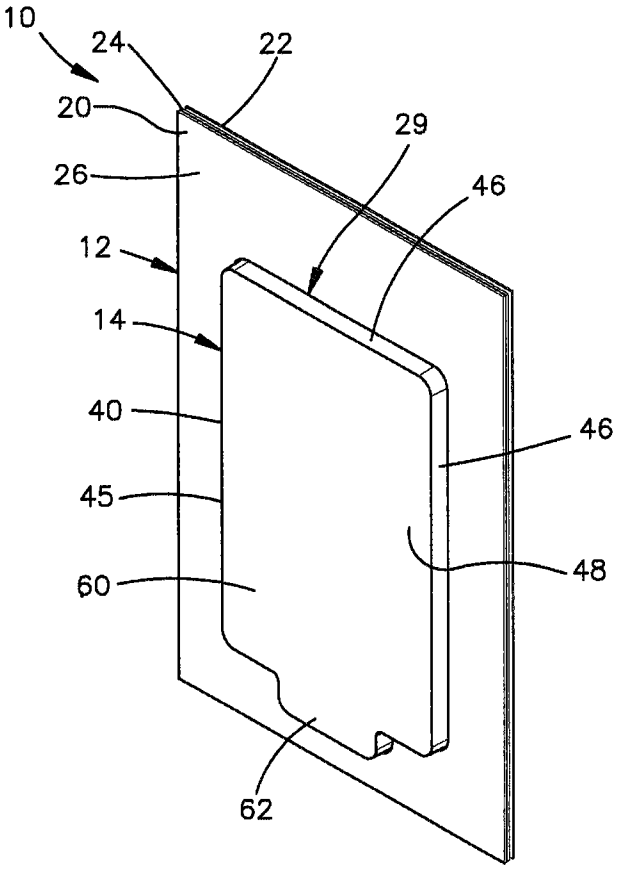
FIG. 1 is a front perspective view of one embodiment of a payment card package assembly.

As shown in FIGS. 1 and 2, an embodiment of a payment card package assembly 10 includes a panel structure 12 and a blister pack 14. The blister pack contains a payment card 16 (FIG. 3), and is preferably formed of transparent plastic material. The panel structure 12, which may be formed of any suitable material such as paperboard, encloses and supports the blister pack 14 for retail display.

Figure 3:
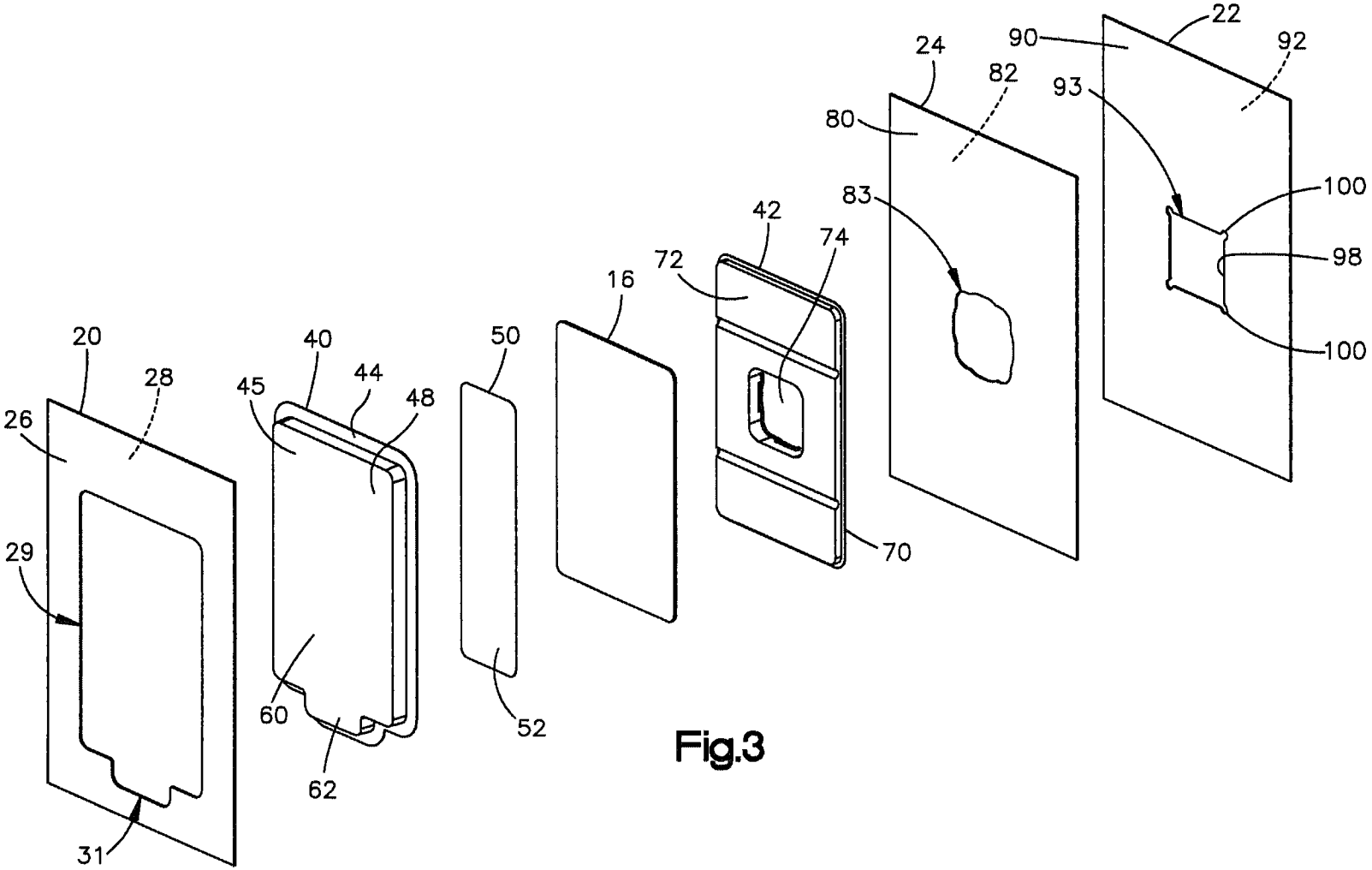
FIG. 3 is an exploded front perspective view of parts of the assembly of FIG. 1.

As best shown in FIG. 3, the panel structure 12 in the illustrated embodiment includes a front panel 20, a rear panel 22, and an intermediate panel 24. The front panel 20 includes a front side 26, a rear side 28, and a cutout 29 therethrough from the rear side 28 to the front side 26. The cutout 29 has an extended portion 31. As used herein, the term "front" when used to refer to a side of any component of the package assembly 10 is intended to refer to the side of component that faces toward a front side of the package assembly 10 when the package assembly 10 is in its fully assembled state. In the case of the illustrated embodiment, the front side of the package assembly 10 is the side shown in FIGS. 1 and 4, which is the side facing downward in FIG. 5. As used herein, the term "rear" when used to refer to a side of any component of the package assembly 10 is intended to refer to the side of component that faces toward a rear side of the package assembly 10 when the package assembly 10 is in its fully assembled state. In the case of the illustrated embodiment, the rear side of the package assembly 10 is the side shown in FIG. 2, which is the side facing upward in FIG. 5.

As further shown in FIG. 3, the blister pack 14 in the illustrated embodiment includes first and second blister pack components 40 and 42. The first blister pack component 40 includes a surrounding flange 44 and a pocket 45. In the package assembly 10, the flange 44 is located toward the rear side 28 of the front panel 20, and the pocket 45 protrudes through the cutout 29 of the front panel 20. A set of sidewalls 46 of the pocket 45 extend from the flange 44 to a front panel 48 of the pocket 45 and also serve to define the general perimeter shape of the pocket 45.

Figure 4:
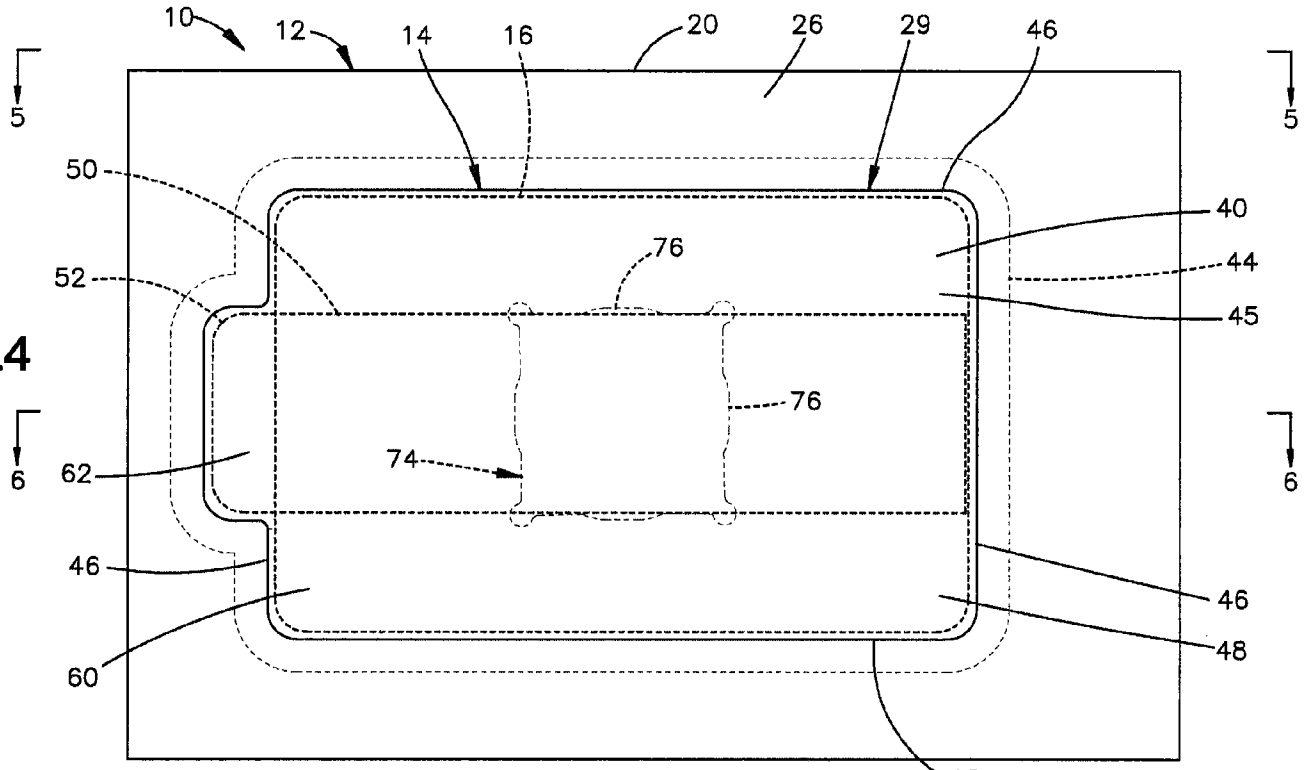
FIG. 4 is a front view of the assembly of FIG. 1.
Figure 5:
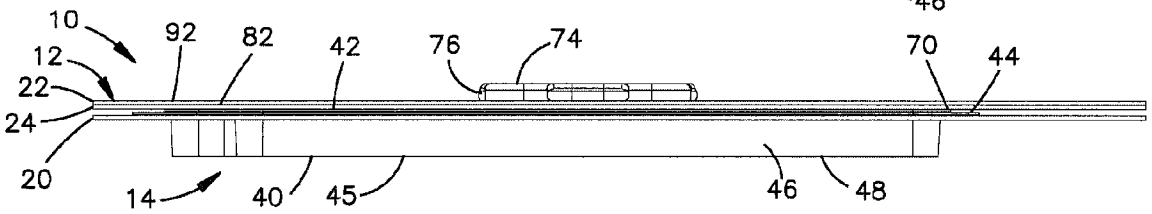
FIG. 5 is a side view taken on line 5-5 of FIG. 4.
Figures 6, 7:
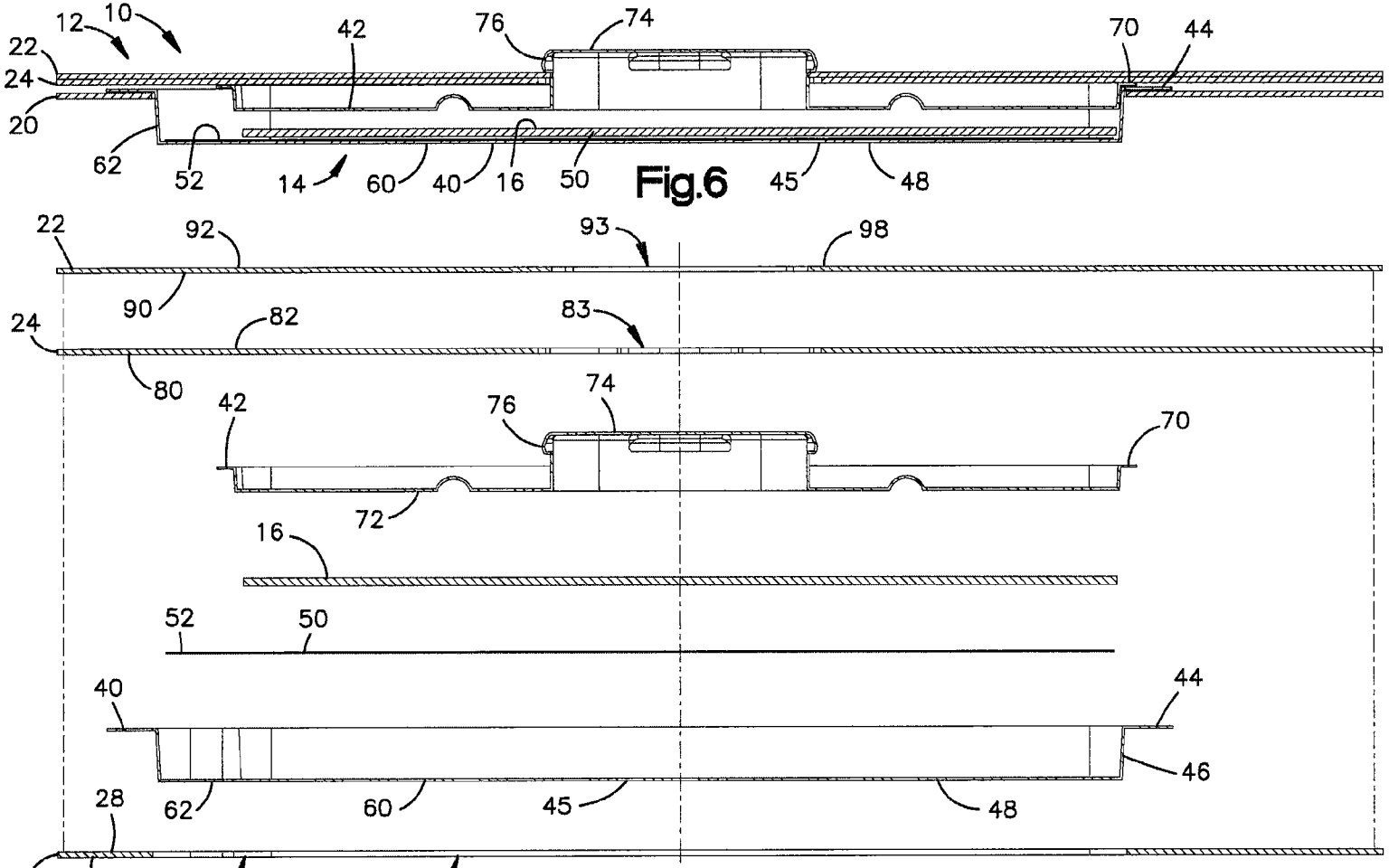
FIG. 6 is a sectional view taken on line 6-6 of FIG. 4.
FIG. 7 is an exploded sectional view of the parts shown in FIG. 6.

As shown in FIGS. 4 and 6, the payment card 16 is positioned within the pocket 45 with a front of the card 16 facing the front of the package assembly 10. The card 16 has a security label 50 applied thereto to cover a card number (not shown) on the front side of the card 16. The security label 50 includes a free portion 52 that extends beyond a perimeter of the card 16.

The pocket 45 has a primary portion 60 and a secondary portion 62. The primary portion 60 has a shape that substantially matches the shape of the payment card 16. The secondary portion 62 is aligned with the free portion 52 of the security label 50 such that the free portion 52 extends into the secondary portion 62.

A terms and conditions document (e.g., legal terms and conditions; not shown) may be positioned within the pocket 45 at a rear side of the payment card 16.

The second blister pack component 42 includes a flange 70, a forward protrusion 72 and a rearward protrusion 74. The flange 70 of the second blister pack component 42 engages with the flange 44 of the first blister pack component 40. The forward protrusion 72 extends into the pocket 45 to locate the payment card 16 toward the front panel 48 of the pocket 45, and the rearward protrusion 74 includes at least one latching feature 76. In one embodiment, the second blister pack component 42 is formed by a single piece, but in other embodiments of the blister pack 14 more than two pieces may be used.

Figure 9:
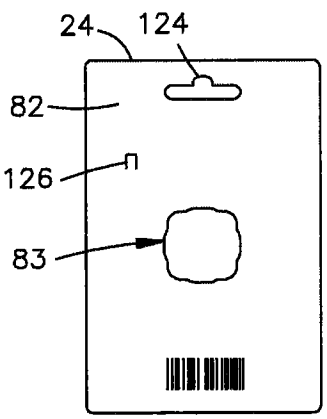
FIG. 9 is a rear view of the intermediate panel shown in FIG. 8.
Figure 8:
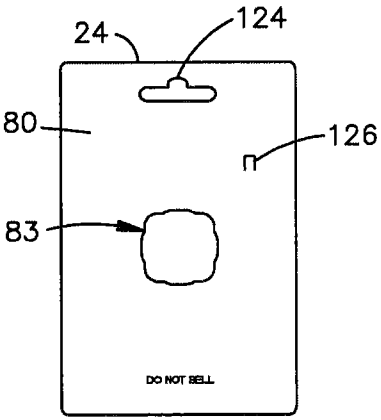
FIG. 8 is a front view of an intermediate panel in the package assembly of FIG. 1.

As shown separately in FIGS. 8 and 9, the intermediate panel 24 has a front side 80, a rear side 82, and a cutout 83 therethrough from the rear side 82 to the front side 80. The front side 80 of the intermediate panel 24 is sealed (e.g., heat sealed by heat activated adhesive, or otherwise adhered or glued) to the rear side 28 of the front panel 20 with both of the blister pack components 40 and 42 sandwiched therein and entirely surrounded by peripheral portions of both the front panel 20 and the intermediate panel 24. The rear protrusion 74 of blister pack component 42 extends through the cutout 83 of the intermediate panel 24 to space the latching feature 76 rearwardly of the rear side 82 of the intermediate panel 14.

Figure 10:
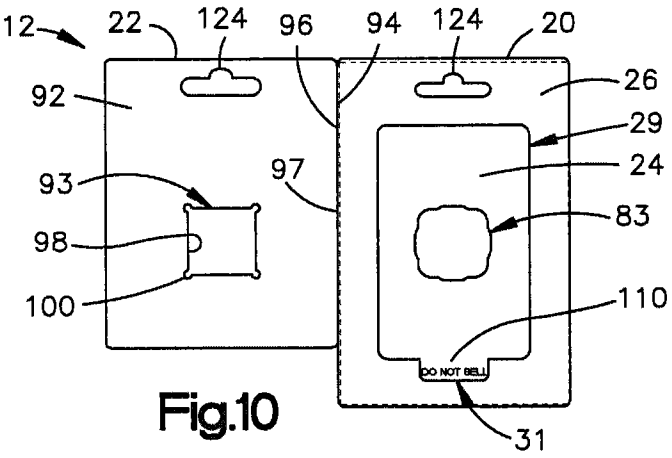
FIG. 10 is a front view of an alternative panel structure in which front and rear panels similar to those in the package assembly of FIG. 1 are pivotably interconnected.
Figure 12:
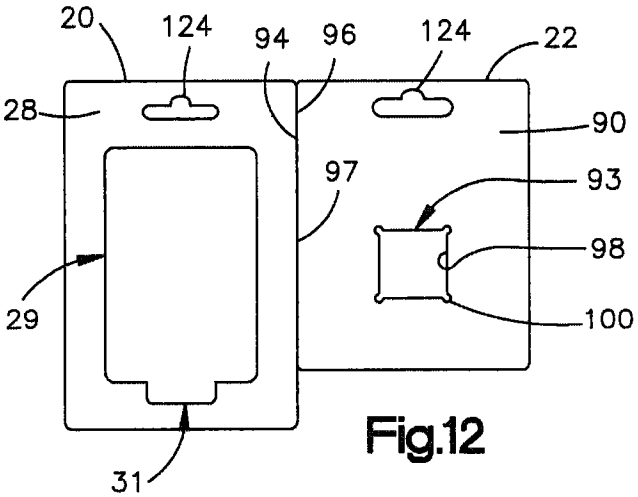
FIG. 12 is a rear view of the front and rear panels in the panel structure of FIGS. 10 and 11.
Figure 11:
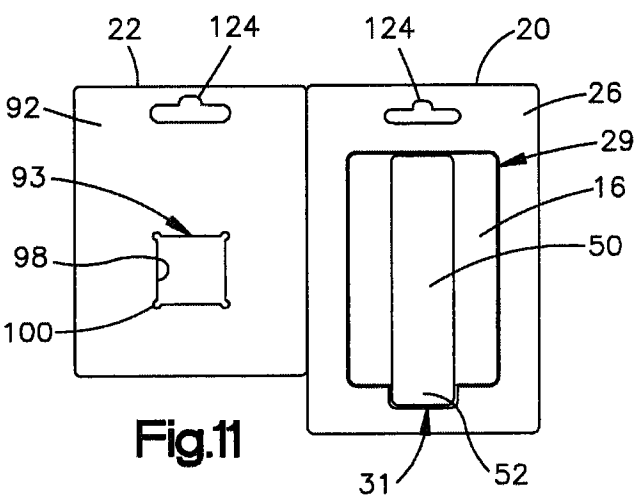
FIG. 11 is a view similar to FIG. 10, showing a payment card in place relative to the panel structure.

The rear panel 22 has a front side 90, a rear side 92 and a cutout 93 therethrough from the front side 90 to the rear side 92. In one embodiment, suggested in FIG. 3, the rear panel may be a separate panel that engages the rear protrusion of the blister pack component. In another embodiment, as shown in FIGS. 10-12, the rear panel 22 also has an edge 94 interconnected with an edge 96 of the front panel 20 along a pivot line 97 therebetween. By way of example, the pivot line 97 may be a score line, a line of perforation or any other line of weakness. The cutout 93 of the rear panel 22 defines an interior panel perimeter portion 98 of the rear panel 22. In the package assembly 10, the rear protrusion 74 of the blister pack component 14 extends through the cutout 93 of the rear panel 22, and the interior panel perimeter portion 98 engages with the latching feature 76 to hold the front side 90 of the rear panel 22 toward the rear side 82 of the intermediate panel 24.

The rear protrusion 74 of the illustrated embodiments includes multiple latching features 76 (e.g., in this case four) and the cutout 93 in the rear panel 22 includes multiple interior panel perimeter portions 98 (e.g., in this case four), with each interior panel perimeter portion 98 engaged with a respective one of the latching features 76. Corner slots or recesses 100 of the cutout 93 provide each of the perimeter portions 98 with some ability to flex in order to move over and past the latching features 76 in a releasable manner. This allows the package assembly 10 to be partially opened by re moving the rear panel (e.g., if the rear panel is separate) or by pivoting the rear panel 22 away from the intermediate panel 24 such that the rear side 92 of the rear panel 22 is positioned alongside the front side 26 of the front panel 20, as shown for example in FIG. 10. In this arrangement, each of the front side 26 of the front panel 20, the rear side 82 of the intermediate panel 24, the front side 90 of the rear panel 22 and the rear side 92 of the rear panel 20 have printed information thereon pertaining to the payment card 16. Likewise, where rear panel 22 is separate, both the front and rear sides of the rear panel may include printed information thereon. Thus, in either case, four panel surfaces are made available for providing the retail customer with any required information about the payment card 16 when the package assembly 10 is partially opened, while providing a relatively small peripheral footprint for the package assembly 10 when the package assembly 10 is fully closed (i.e., with the separate rear panel 22 placed adjacent the rear panel and held in place by the latching feature 76 or with the pivotable rear panel folded against the intermediate panel 24 and held in place by interaction with the latching feature 76, both of which cases are fairly represented by the package profile of FIG. 5).

Notably, the front side 80 of the intermediate panel 24 includes warning indicia 110, as shown in FIG. 8. In the package assembly 10, the warning indicia 110 on the intermediate panel 24 is aligned with the extended portion 31 of the cutout 29 in the front panel 20, as shown in FIG. 10. The warning indicia 110 is thus aligned with the secondary portion 62 of the pocket 45 in the package assembly 10. The free portion 52 of the security label 50 extends into the extended portion 31 of the cutout 29 in the front panel 20, as shown in FIG. 11. The free portion 52 of the security label 50 is thus positioned in the secondary portion 62 of the pocket 45 to block viewing of the warning indicia 110 from the front of the package assembly 10 through the secondary portion 62 of the pocket 45 (e.g., per FIG. 4). In the absence of the free portion 52 of the security label 50 being located within the secondary portion 62 of the pocket 45, the warning indicia 110 becomes viewable from the front of the package assembly 10. In the event someone tampers with the card 16 (e.g., by removing the card 16 from the package 10, removing the security label 50 to obtain the card number and then reinserting the card 16 back into the package 10 without the security label 50), the warning indicia 110 is viewable to warn both the customer and the retail establishment that the payment card 16 has been compromised.

The security label 50 may be of a type such that when removed or partially removed from the payment card 16, tamper indicia is produced that remains visible even if the security label 50 is re-applied to the payment card 16. By way of example, security labels having a tamper evident feature are available from Sekuworks, LLC of Harrison, Ohio.

The security label 50 may held to the payment card 16 by adhesive at a rear side of the security label 50, while the free portion 52 of the security label 50 is non-adhesive. By way of example, the free portion 52 of the security label 50 may lack adhesive at its rear side or may include deadening over adhesive at its rear side.

Thus, a method of providing a tamper evident payment card for retail sale is also provided with such a package assembly. The method involves applying a security label over a card number on a front side of the payment card, the security label having a free portion that extends beyond an outer edge of the payment card.

In such a method the security label may be held to the payment card by adhesive at a rear side of the security label, and the free portion of the security label may be non-adhesive such that the free portion of the security label will not adhere to material with which it comes into contact (e.g., the free portion of the security label lacks adhesive at its rear side or includes deadening over adhesive at its rear side).

The method further involves loading the payment card into a blister pack pocket having a primary portion and a secondary portion, the primary portion having a shape that substantially matches a shape of the payment card, the secondary portion aligned with the free portion of the security label such that the free portion extends into the secondary portion.

The method further involves providing warning indicia on a package part behind the free portion of the security label and in alignment with the secondary portion of the pocket, wherein the warning indicia is blocked from view through a front side of the blister pack pocket by the free portion of the security label.

In the absence of the free portion of the security label within the secondary portion of the pocket, the warning indicia becomes viewable from the front side of the blister pack pocket.

In a summary of the full method, the front panel is placed front side down in an assembly pan, the first blister packet is placed front side down with the pocket extending through the front panel, the payment card (with security label already applied) is placed front side facing down within the pocket and with the free portion of the label in the secondary portion of the pocket, the terms and conditions document is placed in the pocket at the rear side of the payment card, the second blister pack component is positioned with forward protrusion in the pocket of the first blister pack component and the rear protrusion extending through the intermediate panel (e.g., the second blister pack component may be combined with the intermediate panel before such placement) and the intermediate panel is heat sealed to the front panel to secure the payment card in the package, and then the rear panel can be pivoted to a closed position against the intermediate panel to complete the package. The front, intermediate and rear panels are pre-printed with desired information before the assembly process.

A bar code may be provided on the rear side 82 of the intermediate panel 24 for the purpose of scanning during sale to activate the payment card 16.

Figure 13:
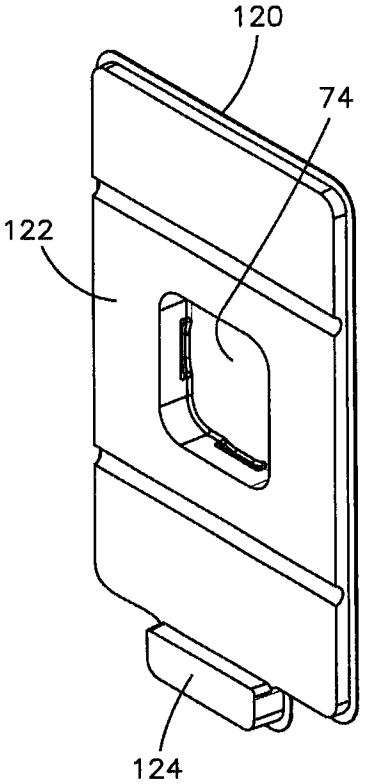
FIG. 13 is a front perspective view of an alternative embodiment of a secondary blister pack component that may be used in a payment card package assembly.

Referring to FIG. 13, in a variation of either above embodiment, the payment card package assembly may include an alternative second blister pack component 120 in place of the second blister pack component 42 described above. Such an embodiment could have other parts that are the same or substantially the same as the other parts of the assembly 10 described above. Like the second blister pack component 42 described above, the second blister pack component 120 of this embodiment includes a primary forward protrusion 122 that aligns with the primary portion 60 of the pocket 45. Additionally, the second blister pack component 120 of this embodiment further includes a secondary forward protrusion 124 that aligns with the secondary portion 62 of the pocket 45. The secondary forward protrusion 124 extends beyond the primary forward protrusion 122 to assure that the free portion 52 the security label 50 is held firmly against the front face 48 of the pocket 45 in the secondary portion 62 of the pocket 45.

Variations are, of course, possible. For example, each the panels 20, 22 and 24 may include an additional cutout 124 as shown in FIGS. 8-12, where the additional cutouts 124 align and can be used for hanging the package assembly 10. In addition, the intermediate panel 24 may include a dies cut 126 to create a tab that can be pulled to tear open the intermediate panel 24 and access the payment card 16 within the pocket 45.

Figure 14:
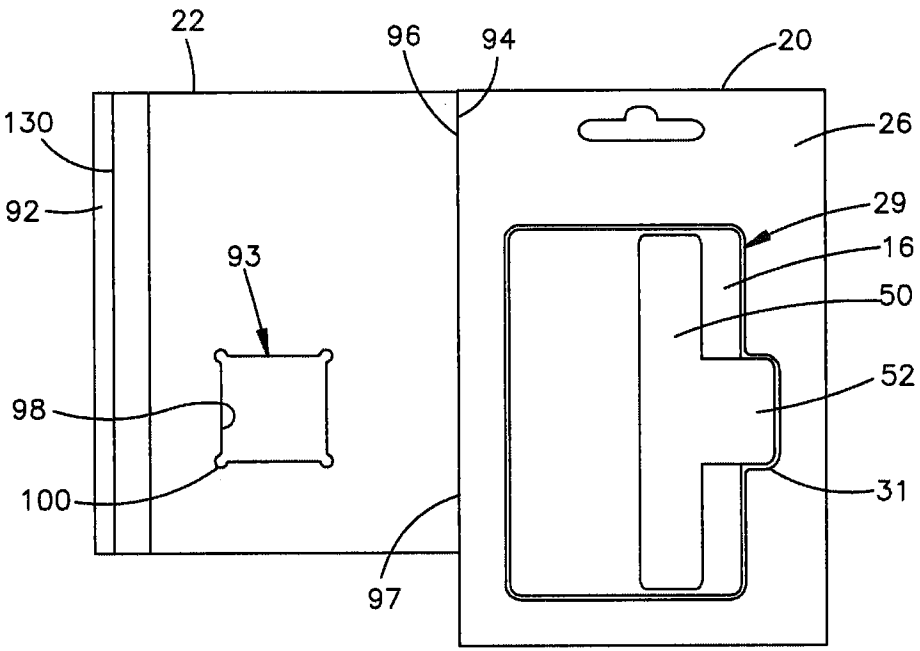
FIG. 14 is a view similar to 11, showing parts of another alternative embodiment of a payment card package assembly.

Further, although the primary embodiments described above include the secondary portion 62 of the pocket 45 at the bottom of the package 10, such secondary portion 62 could alternatively be located at the top or either one of the sides. By way of example, FIG. 14 shows an embodiment in which the secondary portion 62 of the pocket 45 is located to the right side of the primary portion 60 of the pocket 45, and the free portion 52 of the security label 50 likewise extends to the right. This arrangement may enable a smaller overall package footprint while at the same time maintaining sufficient spacing for proper sealing in the region between the blister pack cutout and the additional cutout used for package hanging. Although in FIG. 14 the right hand portion of the security label 50 shown generally in the center portion of the card 16 (except for the part connecting to free portion 52), it is recognized that the right hand portion of the security label 50 could, alternatively, extend to the right hand edge of the card 16.

FIG. 14 also shows the use of a magnetic stripe 130 on the rear side 92 of the rear panel 22, which magnetic stripe 130 can be swiped at check-out for the purpose of activating the payment card 16. The magnetic stripe can be used in lieu of a bar code (shown in FIG. 9), or both the magnetic stripe 130 and a bar code can be provided in the same package to provide the ability to use either for the purpose of card activation.

Figure 17:
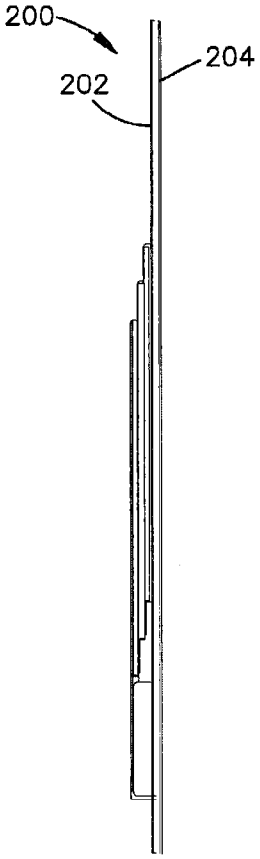
FIGS. 15-17 show an embodiment of a payment card package assembly with multiple payment cards.
Figure 16:
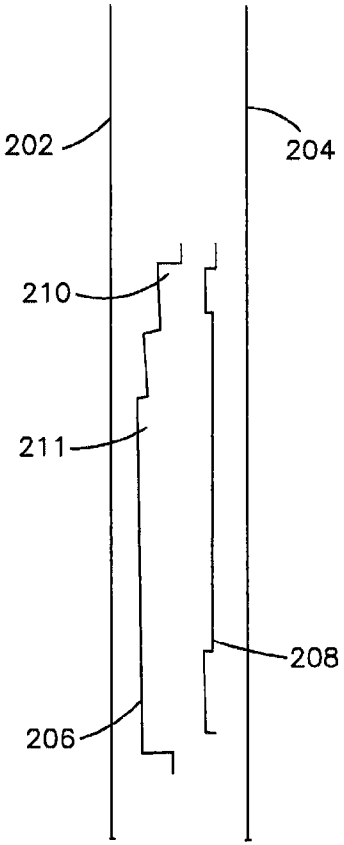
Figure 15:
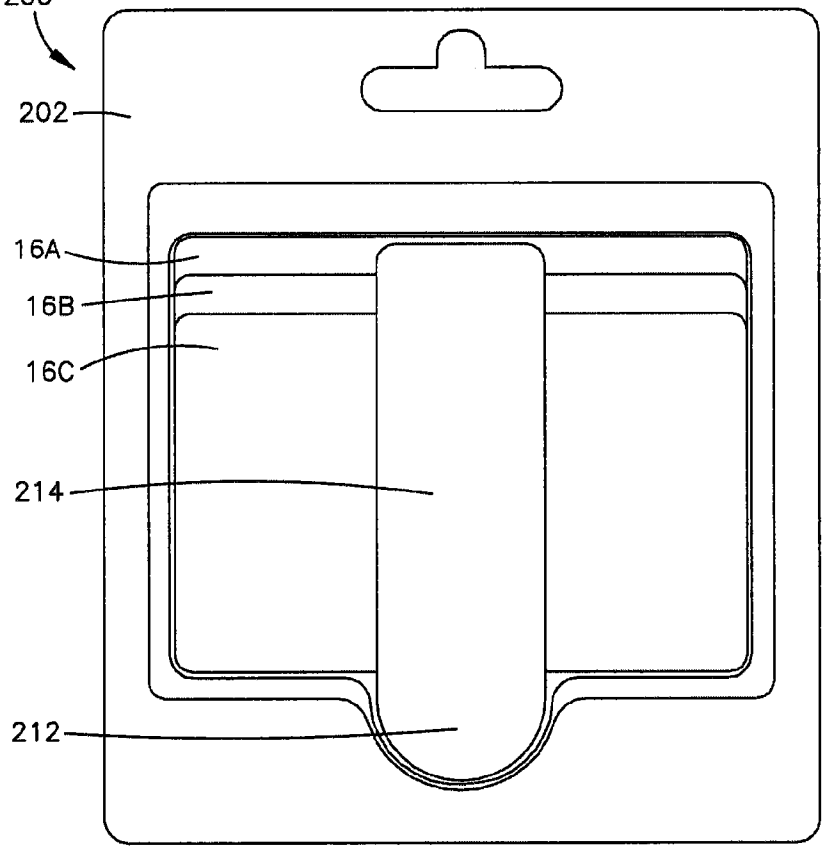

Referring now to FIGS. 15-17, an embodiment of a payment card package assembly 200 including multiple payment cards 16A-16C is shown, with the cards arranged in an overlapping staggered orientation. The package assembly includes a front panel 202 and a rear panel 204, a front blister component 206 that includes a flange and pocket and a rear blister component 208 with a flange and one or more protrusions that extend forward into the pocket to push the cards to the front of the pocket. The payment cards may, if desired, also be adhered to the front side of the rear blister component 208 (e.g., as by using fugitive glue). The payment cards are not shown in the exploded side-cross section of FIG. 16.

As previously described, on assembly the front and rear panels 202 and 204 are heat sealed together (or otherwise adhered or glued to each other in another manner), with the blister components 206 and 208, having the payment cards 16A-16C only or payment cards and other documentation (e.g., terms and conditions) within the pocket, held therebetween. Notably, the pocket includes a primary portion 210 that holds the cards and a secondary portion 211 that receives a free portion 212 of a security label 214 that is applied to the cards, with the security label adhered to at least a portion of each of the payment cards in the package. In the illustrated embodiment the security label covers the card number on the most front one of the payment cards, but only an edge portion of the two rear payment cards, but variations are possible. The front side of the rear panel 204 includes warning indicia (e.g., "DO NOT SELL IF VISIBLE") that is covered by the free portion 212 of the security label 214. The security label 214 produces warning indicia if removed from the cards 16A-16C, even if an attempt is made to reapply the label 214, and the removal of the security label 214 altogether exposes the aforementioned warning indicia at the front side of the rear panel 204. Thus, in the absence of the free portion 212 of the security label 214, the warning indicia is viewable from the front side of the package assembly 200 through the blister pack components 206 and 208. The rear side of the rear panel 204 may include a bar code or magnetic stripe for scanning (e.g., optical scan or magnetic swipe scan) to activate the payment cards 16A-16C (e.g., a single scan activates all of the cards). Alternatively, the rear panel 204 could include an opening aligned with a bar code or magnetic stripe on the rear side of one of the payment cards 16A-16C so that scanning of the bar code or magnetic stripe of the one payment cards 16A-16C activates all of the payment cards 16-A-16-C in the pack.

Figure 20:
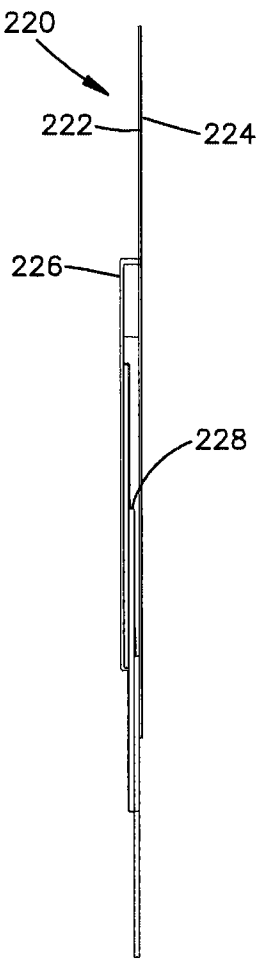
FIGS. 18-20 show another embodiment of a package assembly with multiple payment cards.
Figure 19:
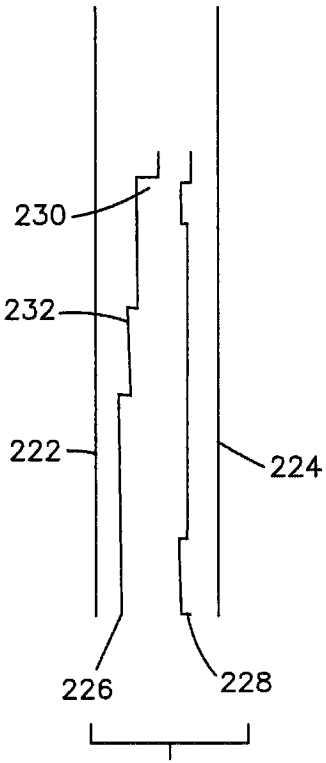
Figure 18:
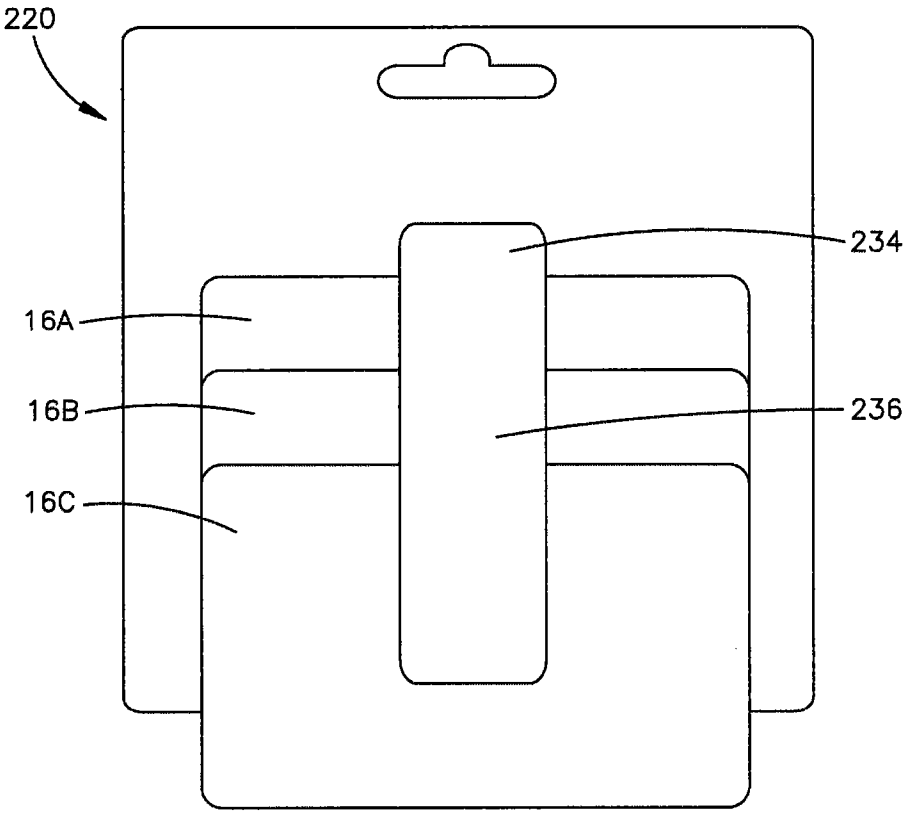

Referring now to FIGS. 18-20, another embodiment of a payment card package assembly 220 including multiple payment cards 16A-16C is shown, with the cards arranged in an overlapping staggered orientation. The package assembly includes a front panel 222 and a rear panel 224, a front blister component 226 that includes a flange and pocket and a rear blister component 228 with a flange and one or more protrusions that extend forward into the pocket to push the cards to the front of the pocket. The payment cards may, if desired also be adhered to the front side of the rear blister component 228 (e.g., as by using fugitive glue). The payment cards are not shown in the exploded side-cross section of FIG. 19.

As previously described, on assembly the front and rear panels are heat sealed together (or otherwise adhered or glued to each other in another manner), with the blister components, having the payment cards only or payment cards and other documentation (e.g., terms and conditions) within the pocket, held therebetween. However, in this embodiment the bottom part of the blister components provides a slot through which the lower end of the rear payment card 16C extends so as to be exposed below the panels 222 and 224. In this manner, a bar code or magnetic stripe at the rear side of the card 16C is exposed so as to be easily scannable for the purpose of activating all of the payment cards 16A-16C in the package 220.

Notably, the pocket includes a primary portion 230 that holds the cards 16A-16C and a secondary portion 232 that receives a free portion 234 of a security label 236 that is applied to the cards 16A-16C, with the security label 236 adhered to at least a portion of each of the payment cards 16A-16C in the package 220. In the illustrated embodiment the security label 236 covers the card number on the most front one 16C of the payment cards 16A-16C, but only an edge portion of the two rear payment cards 16A and 16B, but variations are possible. The front side of the rear panel 224 includes warning indicia (e.g., "DO NOT SELL IF VISIBLE") that is covered by the free portion 234 of the security label 236. The security label 236 produces warning indicia if removed from the cards 16A-16C, even if an attempt is made to reapply the label 236, and the removal of the security label 236 altogether exposes the aforementioned warning indicia at the front side of the rear panel 224. Thus, in the absence of the free portion 234 of the security label 236, the warning indicia is viewable from the front side of the package assembly 220 through the blister pack components 226 and 228.

Figure 23:
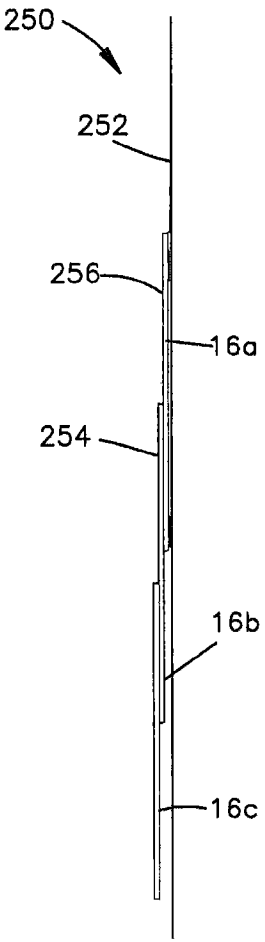
FIGS. 21-23 show an additional embodiment of a payment card package assembly with multiple payment cards.
Figure 22:
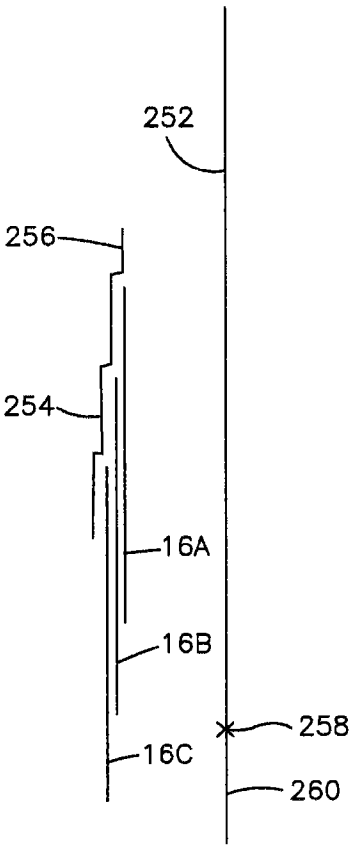
Figure 21:
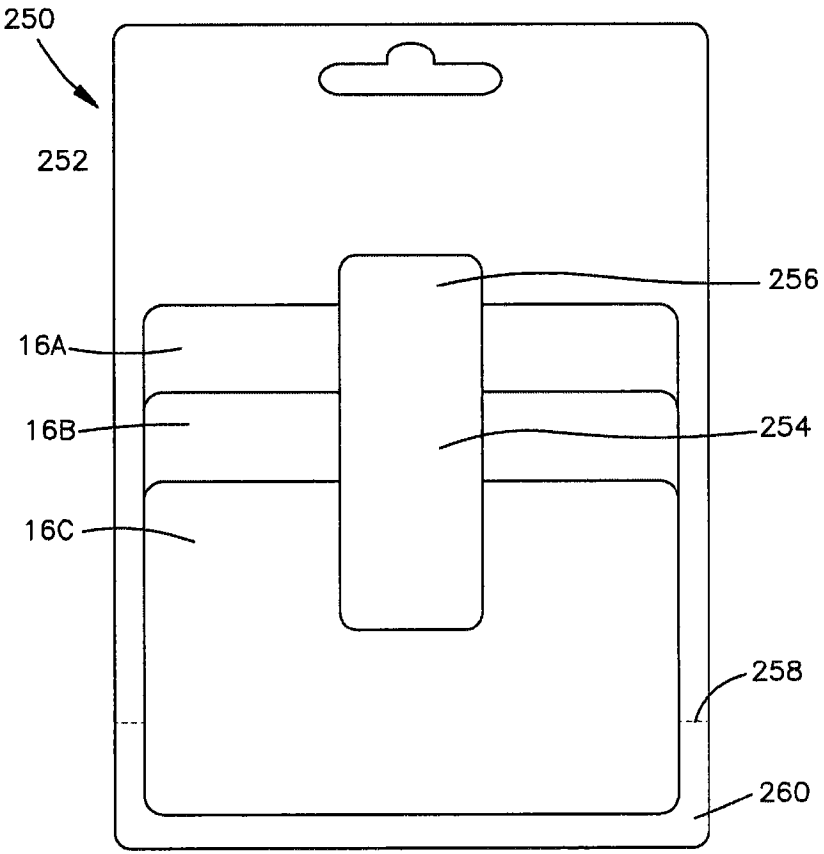

An even simpler embodiment of a package assembly 250 with multiple payment cards 16A-16C is shown in FIGS. 21-23. In this embodiment a single panel 252 is provided, with each of the payment cards 16A-16C being adhered to the front side of the panel 252 (e.g., by the use of fugitive glue). No blister pack components are used. The security label 254 adheres to the front side of a portion of each of the payment cards 16A-16C, and a free portion 256 of the security label 254 adheres to the front side of the panel 252, covering warning indicia on the front side of the panel 252. The security label 254 produces warning indicia if removed from the cards 16A-16C, or if removed from the panel 252, even if an attempt is made to reapply the label 254, and the removal of the security label 254 altogether exposes the aforementioned warning indicia at the front side of the panel 252. Thus, in the absence of the free portion 256 of the security label 254 the warning indicia is viewable from the front side of the package assembly 250.

The panel 252 may include a lateral line of weakening (e.g., score line or perforation line) 258 that enables a lower part 260 of the panel 252 to be pivoted away from the rear side of the payment card 16C, thereby exposing a bar code or magnetic stripe at the rear side of the payment card 16C to enable scanning of the bar code or magnetic stripe for the purpose of activating all of the payment cards 16A-16C of the package 250. In a variation of the FIG. 22 arrangement, the lower part 260 of the panel 252 could be removed altogether.

Figure 25:
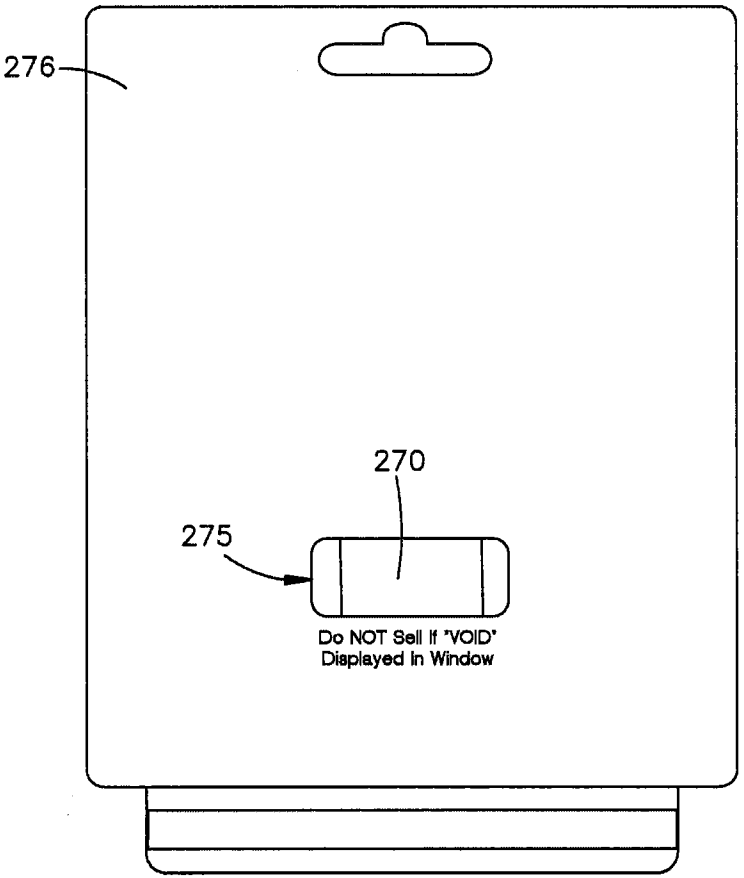
FIGS. 24 and 25 show another additional embodiment of a payment card package assembly with multiple payment cards.
Figure 24:
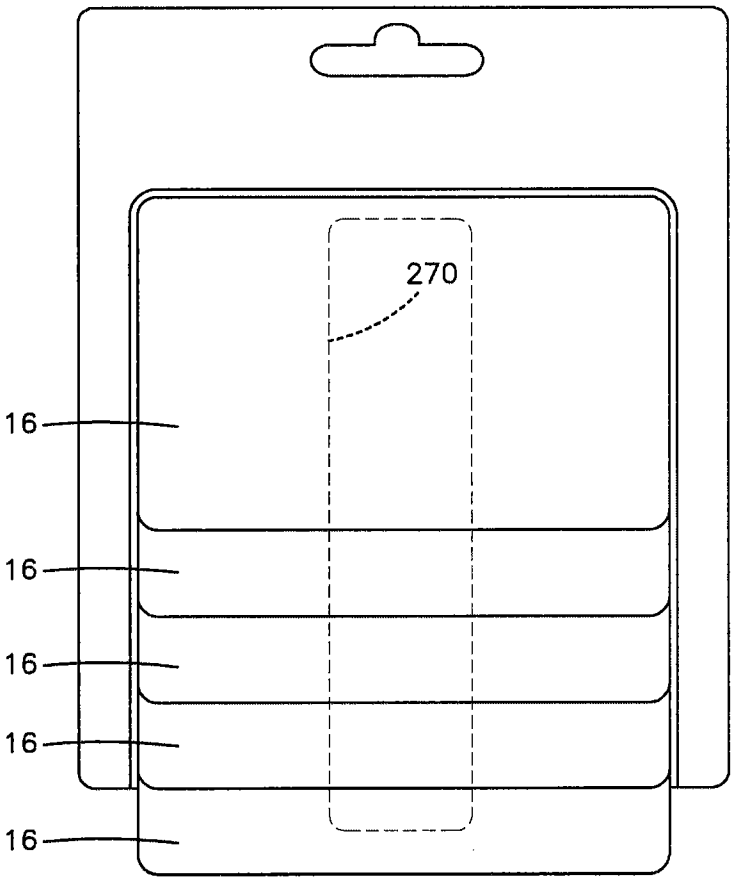

Other variations of payment card package assemblies are possible. For example, a security label 270 could be applied to the rear side of the cards 16, with a window 275 in a rear panel 276 providing a tamper evident indication (e.g., visible warning indicia) if the security label 270 has been removed. FIGS. 24 and 25 reflect such a potential variation.

Moreover, an embodiment in which a one piece blister is sealed directly to the front face of a single panel could also be provided, with security label used on the card or cards per one of the above embodiments.

Figure 27:
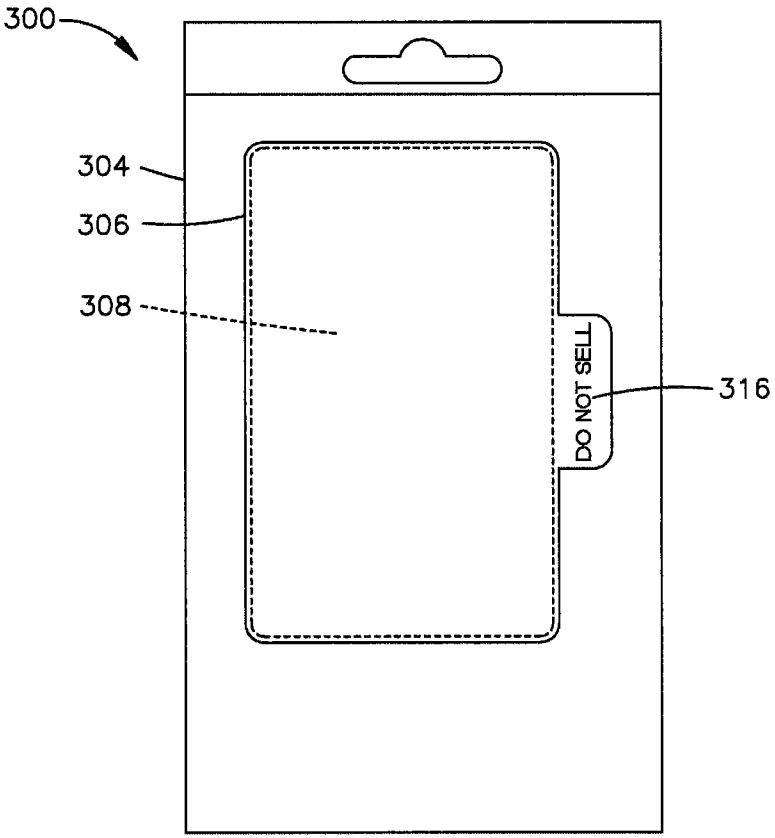
FIGS. 26-29 show an embodiment of a payment card package assembly with a box part and a card holding part hingedly connected together.
Figure 26:
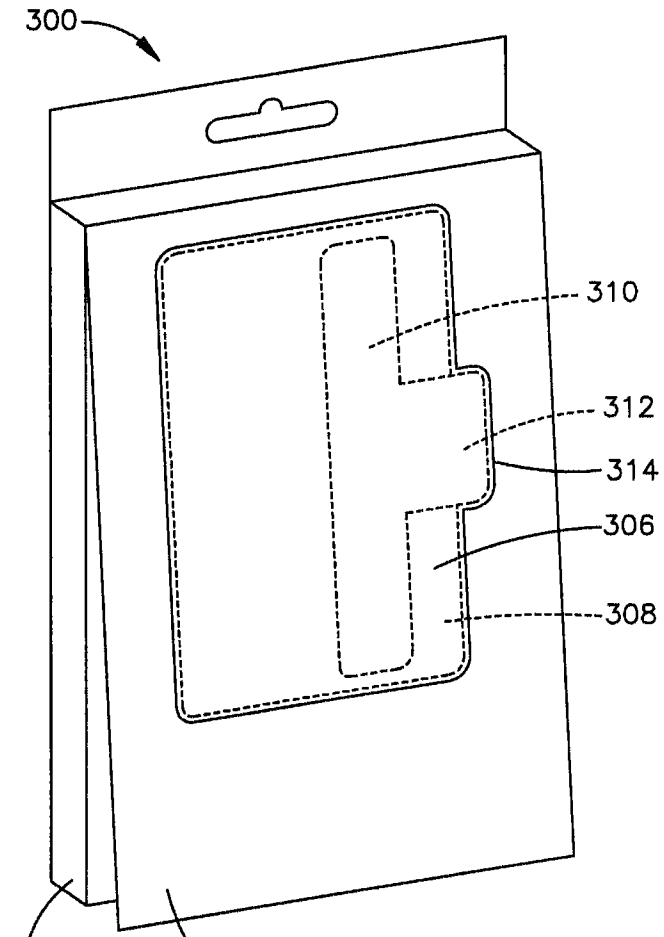

Referring now to FIG. 26, a package assembly 300 includes a combination of a multi-panel, blister and card part 302 with a box part 304. Part 302 is formed by two panels secured together with a single flanged blister 306 held by the panels, and a card 308 within the pocket of the blister 306. A security label 310 is applied over the face of the card 308 to hide the card number, and includes an overhanging portion 312 that aligns with a secondary portion 314 of the blister pocket. As seen in FIG. 27, if the security label 310 is removed, warning indicia 316 on the front side of the rear panel of part 302 is visible through the blister.

Figure 29:
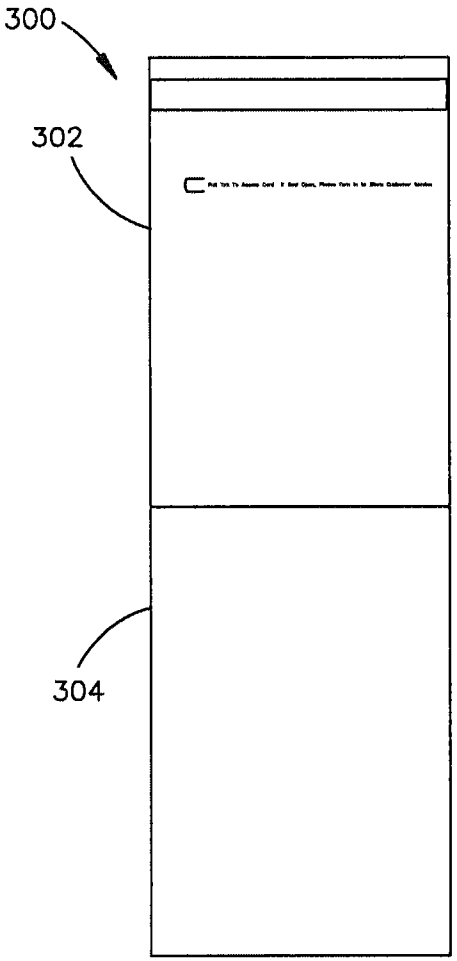
Figure 28:
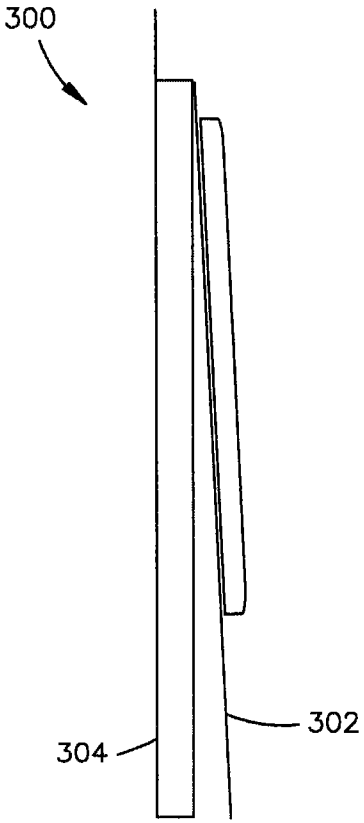

As shown in FIG. 28, the card holding part 302 is hinged to the top of the front panel of the box part 304. The card holding part 302 thus acts as a flap that can be folded upward as shown in FIG. 29 to reveal information regarding the card (i.e., information located on the rear side of the rear panel of part 302 and information on the front side of part 304), as well as a bar code and/or magnetic stripe that can be used for activating the card or cards 308 at the point of sale. The box part 304 may typically contain the terms and conditions for the card(s). Although the illustrated embodiment contemplates a single blister component in card holding part 302, it is possible that a two piece blister system similar to that previously described could also be used.

Figure 31:
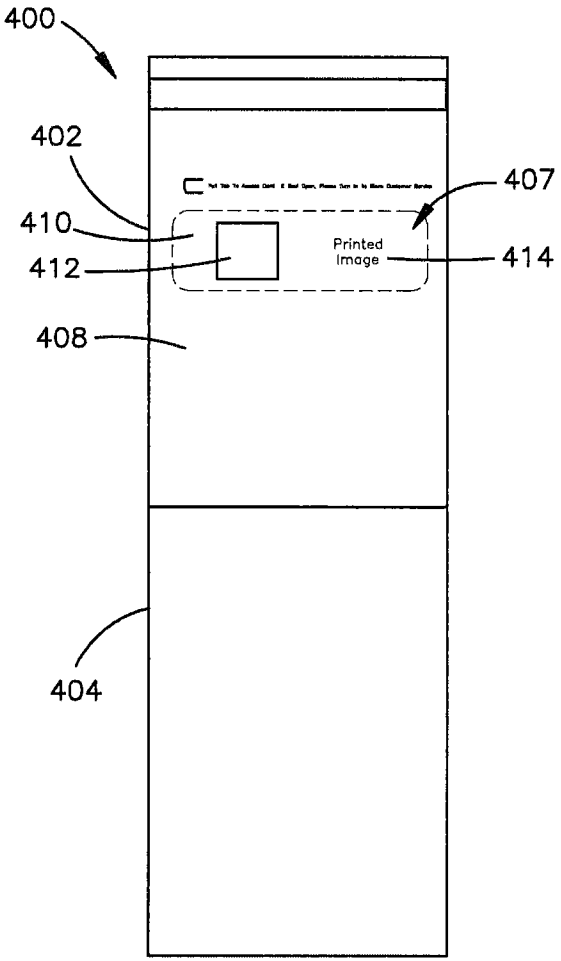
FIGS. 30-31 show another embodiment with a box part and a card holding part hingedly connected together.
Figure 30:
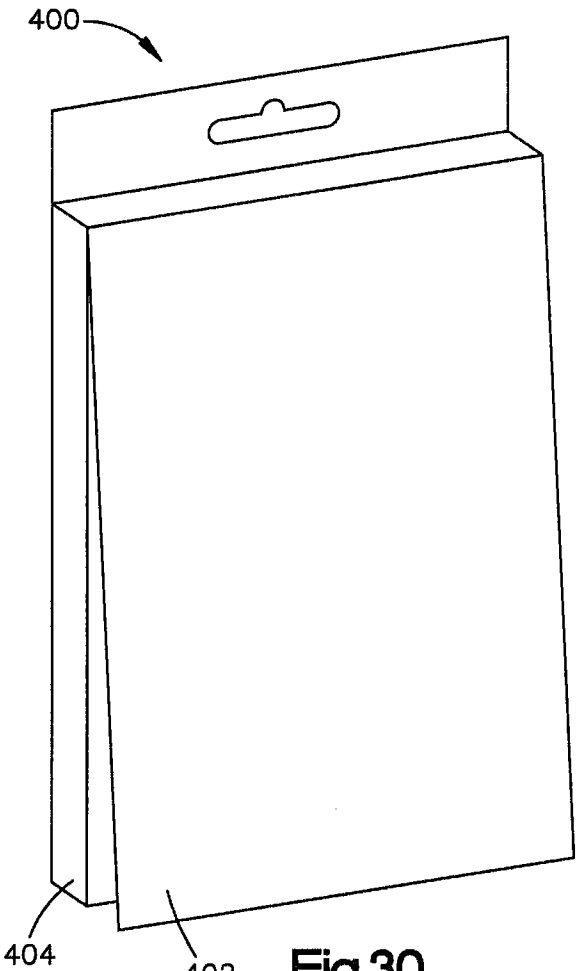

Moreover, the blister component could be eliminated entirely as in the payment card package assembly 400 of FIGS. 30-31, which includes a card holding part 402 hinged to the top of a box part 404. In this embodiment the card holding part 402 is simply formed by front and rear panels with the payment card(s) contained therein. The payment card is not visible in a front view of the assembly 400. However, a window 407 (e.g., either completely open or covered by plastic) is provided in the rear panel 408 of the card holding part 402. In this arrangement, the payment card would include a security label 410 that includes a portion that aligns with the window 407. That portion of the security label includes an image thereon 412 (not shown) that matches a corresponding image 414 on the card-holding part 402. If the security label 410 is removed, that image 412 does not appear in the window 407 and serves as an indicator to customers and sales clerks that tampering has occurred.

Further, the box part of each of the embodiments of FIGS. 26-31 could be replaced with some other form of documentation holding part.

It is to be clearly understood that the above description is intended by way of illustration and example only, is not intended to be taken by way of limitation, and that other changes and modifications are possible. For example, any one or more of the parts of each embodiment may be used in combination with any one or more of the parts of another embodiment.

What is claimed is:

1. A payment card package assembly, comprising:

a payment card having a card number thereon;

a panel having a front side, and having warning indicia on the front side at a location outward of the perimeter of the payment card;

a security label having a first portion that covers at least a portion of the card number, and having a second portion that covers the warning indicia in a front view of the assembly; and a blister pack having a primary portion that contains the payment card and the first portion of the security label, and having a smaller secondary portion that projects from the primary portion and contains the second portion of the security label.

2. The payment card package assembly of claim 1 wherein the first portion of the security label is adhered to the payment card, and the second portion of the security label is unattached to the panel.

3. The payment card package of claim 1 wherein the payment card has a front side that is visible in the front view of the assembly, and the card number is located on the front side of the payment card.

4. The payment card package assembly of claim 1 wherein the second portion of the security label extends from the perimeter of the payment card toward and over the warning indicia on the panel.

5. The payment card package assembly of claim 1 wherein the payment card is rectangular with opposite sides and opposite ends, and the second portion of the security label extends from either an end of the payment card or a side of the payment card.

6. The payment card package assembly of claim 1 further comprising a front panel having a cutout that is aligned with the warning indicia and through which the second portion of the security label is visible in the front view of the assembly.

7. The payment card package assembly of claim 1 wherein the security label is of a type that when removed or partially removed from a surface to which the security label is adhered, tamper indicia is produced that remains visible even if the security label is re-applied to the surface.

8. A payment card package assembly, comprising:

a payment card having a card number thereon;

a security label having a first portion covering at least a portion of the card number, and having a second portion extending beyond the perimeter of the payment card, wherein the first portion of the security label is adhered to the payment card so that the security label will remain with the payment card after removal of the payment card from the package assembly; and a blister pack defining a pocket having a primary portion that contains the payment card and the first portion of the security label, and having a smaller secondary portion that projects from the primary portion and contains the second portion of the security label.

9. The payment card package assembly of claim 8 wherein the blister pack has a front component defining the pocket, and has a rear component that extends into the pocket to position the payment card and the second portion of the security label toward the front component, wherein the rear component has a primary portion that extends a first distance into the primary portion of the pocket and a secondary portion that extends a greater distance into the secondary portion of the pocket.

10. The payment card package assembly of claim 8 wherein the primary portion of the pocket has a rectangular periphery with opposite sides and opposite ends, and the secondary portion of the pocket projects from either an end of the primary portion or a side of the primary portion.

11. The payment card package assembly of claim 8 further comprising a pair of panels adhered together, including a panel with a cutout through which the blister pack protrudes, and the blister pack has peripheral flanges sandwiched between the panels.

12. The payment card package assembly of claim 11 further comprising a pivotal panel interconnected with at least one of the adhered panels along a pivot line.

13. The payment card package assembly of claim 12 wherein the pivotal panel and the blister pack have releasable interlocking latching features.

14. A payment card package assembly, comprising:

a front panel having a front side, a rear side and a cutout therethrough from the rear side to the front side;

a first blister pack component comprising a surrounding flange and a pocket, the flange located toward the rear side of the front panel, and the pocket protruding through the cutout of the front panel;

a payment card positioned within the pocket, the payment card having a security label applied thereto to cover a card number on a front side of the payment card, the security label including a free portion that extends beyond a perimeter of the card;

wherein the pocket has a primary portion and a secondary portion, the primary portion holding the payment card, the secondary portion aligned with the free portion of the security label such that the free portion extends into the secondary portion and blocks viewing of warning indicia that is located within the payment card package assembly behind and in alignment with the free portion of the security label.

15. The payment card package assembly of claim 14 wherein the security label is held to the payment card by adhesive at a rear side of the security label, and the free portion of the security label is non-adhesive.

16. The payment card package assembly of claim 15 wherein the free portion of the security label lacks adhesive at its rear side or includes deadening over adhesive at its rear side.

17. The payment card package assembly of claim 14 wherein:

in the absence of the free portion of the security label within the secondary portion of the pocket, the warning indicia becomes viewable from the front of the package assembly.

18. The payment card package assembly of claim 17 wherein the security label is of a type that when removed or partially removed from the payment card, tamper indicia is produced that remains visible even if the security label is re-applied to the payment card.

19. A payment card package assembly, comprising:

a payment card having a card number thereon;

a security label having a first portion covering at least a portion of the card number, and having a second portion extending beyond a perimeter of the payment card; and a blister pack defining a pocket having a primary portion that contains the payment card and the first portion of the security label, and having a smaller secondary portion that projects from the primary portion and contains the second portion of the security label, wherein the blister pack has a front component defining the pocket, and has a rear component that extends into the pocket to position the payment card and the second portion of the security label toward the front component, wherein the rear component extends a first distance into the primary portion of the pocket and extends a greater distance into the secondary portion of the pocket, wherein the primary portion of the pocket has a substantially rectangular periphery with opposite sides and opposite ends, and the secondary portion of the pocket projects from either an end of the primary portion or a side of the primary portion;

a front panel with a cutout through which the pocket protrudes;

an intermediate panel adhered to a rear side of the front panel, the blister pack having peripheral flanges sandwiched between the front panel and the intermediate panel, the rear intermediate panel having a cutout through which a rear protrusion of the rear component extends; and a rear panel pivotally interconnected with at least one of the front panel or the intermediate panel along a pivot line, wherein the rear panel and the rear protrusion have releasable interlocking latching features to releasably hold the rear panel adjacent the intermediate panel.

* * * * *